US009692129B2

(12) United States Patent
Pantaloni et al.

(10) Patent No.: US 9,692,129 B2
(45) Date of Patent: Jun. 27, 2017

(54) PLANAR ANTENNA FOR RFID READER AND RFID PDA INCORPORATING THE SAME

(71) Applicant: NEOPOST TECHNOLOGIES, Bagneux (FR)

(72) Inventors: Jean-Baptiste Pantaloni, Ucciani (FR); Francis Coret, Gournay sur Marne (FR); Benedicte Nlend, Palaiseau (FR); Christophe Peynet, L'Hay les Roses (FR); Frederic Jost, Deuil la Barre (FR)

(73) Assignee: Neopost Technologies, Bagneux (FR)

( * ) Notice: Subject to any disclaimer, the term of this patent is extended or adjusted under 35 U.S.C. 154(b) by 21 days.

(21) Appl. No.: 14/851,505

(22) Filed: Sep. 11, 2015

(65) Prior Publication Data

US 2016/0079668 A1 Mar. 17, 2016

(30) Foreign Application Priority Data

Sep. 11, 2014 (EP) ..... 14306398

(51) Int. Cl.

| | |
|---|---|
| ***H01Q 1/24*** | (2006.01) |
| ***H01Q 7/00*** | (2006.01) |
| ***H01Q 1/38*** | (2006.01) |
| ***H01Q 1/22*** | (2006.01) |
| ***H01Q 9/42*** | (2006.01) |

(52) U.S. Cl.

CPC ..... *H01Q 7/00* (2013.01); *H01Q 1/2216* (2013.01); *H01Q 1/243* (2013.01); *H01Q 1/38* (2013.01); *H01Q 9/42* (2013.01)

(58) Field of Classification Search

CPC H01Q 7/00; H01Q 1/38; H01Q 1/243; H01Q 1/2216; H01Q 9/42

See application file for complete search history.

(56) References Cited

U.S. PATENT DOCUMENTS

| | | | | |
|---|---|---|---|---|
| 6,295,029 | B1 * | 9/2001 | Chen | H01Q 1/38 343/700 MS |
| 2004/0135726 | A1 | 7/2004 | Shamir et al. | |
| 2005/0116869 | A1 | 6/2005 | Siegler et al. | |
| 2011/0114735 | A1 | 5/2011 | Ziai et al. | |
| 2013/0321212 | A1 * | 12/2013 | O'Shea | H01Q 1/38 343/700 MS |

FOREIGN PATENT DOCUMENTS

| | | |
|---|---|---|
| EP | 0 474 490 A1 | 3/1992 |
| EP | 1 699 108 A1 | 9/2006 |

OTHER PUBLICATIONS

European Search Report, dated Feb. 16, 2015, for European Application No. 14 30 6398, 1 page.

* cited by examiner

*Primary Examiner* — Hoang Nguyen

(74) *Attorney, Agent, or Firm* — Seed IP Law Group LLP

(57) ABSTRACT

A planar antenna comprising: a substrate (10) having opposed first (10A) and second (10B) flat faces; the first flat face comprising a first ground (12), a second ground (14), a feed track (16) there between and an antenna pattern (18) and the opposed second flat face comprising a third ground (20); the third ground being connected to first and second grounds for assuring the continuity of the ground plane with the feeding; and the antenna pattern forms a coil line disposed into the remaining surface of the first flat face and comprises two overlapped loops in such a way that the antenna pattern is substantially auto-complementary.

18 Claims, 2 Drawing Sheets

PLANAR ANTENNA FOR RFID READER AND RFID PDA INCORPORATING THE SAME

FIELD OF THE INVENTION

The present application relates to radiofrequency identification data (RFID) readers embedded into personal digital assistants (PDA), laptops, cell phones or other portable electronic devices such as Internet equipped hand-held computers and more particularly to a planar antenna for an active RFID reader compatible with international standard ISO 18000-7.

BACKGROUND

Today's business practices often require that industrial products be traced during the production and distribution phases and more particularly in the case of high value industrial products. Generally, an identification data (ID) device attached to each industrial product is required. For productivity purposes, such an ID device needs to be read remotely and automatically by electronic interrogators/readers. Automation also reduces errors in information capture and allows for more accurate and more regular inventory management. This requires ID device, which however can communicate. Radiofrequency communication is a preferred solution as it allows for a diffuse transmission and is tolerant to being hidden, as opposed to optical solutions such as those using barcodes, which are more directive and quite intolerant to blocking bodies in the transmission path. The use of RFID tags is an economical and efficient method for such systems.

Typically, depending on the applications, different frequencies can be used, each corresponding to an ISO international standard and/or an EPC Global industrial standard. For example, the frequency range 860-930 MHz used for passive RFID corresponds to ISO 18000-6c and EPC Gen 2 Class 1 UHF and similarly the 13.56 MHz frequency corresponds to ISO 18000-3. The 433 MHz band used for active RFID corresponds to ISO18000-7.

It is known that personal digital assistants ("PDA") or hand-held computers, which include memory means for storing various application programs, have however limited functionality for RFID communication. So they generally comprise in addition an expansion connector for interconnecting with different compatible modules (called add-ons), such as an active RFID module as illustrated in FIG. 4 or a barcodes module. However, once such an add-on module is connected to the PDA, the resulting combined device is bulky and not rugged enough to be used in industrial environment (particularly in regards with sealing and frequency sturdiness) and not well secured to the PDA, the two elements being able to break under manipulations for example. Moreover, the portability and the palm fitted design, which are a primary benefit of a PDA is especially affected by this adjunction of additional functions that provide a combined device considerably larger in depth and/or in width than the one originally designed by the manufacturer.

So, at present, no industrial solutions are disclosed and there is a substantial need for a hand-held computer like a PDA having additional functions such as an active RFID module and at least a barcodes module and that is particularly rugged and easy to grasp for a typical user.

SUMMARY

The object of the invention can be summarized as an antenna that has a high sturdiness and a small footprint to be embedded in a PDA in order to avoid the use of an add-on.

To this end, embodiments of the invention provide a planar antenna comprising:

- a substrate having opposed first and second flat faces;
- the first flat face comprising a first ground, a second ground, a feed track and an antenna pattern and the opposed second flat face comprising a third ground;
- the second ground being separated from the first ground by the feed track;
- the third ground being connected to first and second grounds for ensuring the continuity of the ground plane;

wherein the antenna pattern forming a coil line is disposed into the remaining surface of the first flat face and comprises two overlapped loops in such a way that the antenna pattern is substantially auto-complementary.

With this configuration with two grounds on a same face, a big and a small one, and an auto-complementary antenna pattern, a notable reduction of the dimensions of the antenna is possible authorizing its incorporation in a portable device without the necessity of using an add-on.

Typically, such a planar antenna can be constituted by a printed circuit board (PCB).

Preferably, the first ground have a surface corresponding to about half of the entire surface of the first flat face and the second ground have a surface corresponding to about a tenth of the first ground;

According to an embodiment, said two overlapped loops comprise an external loop having a length and a width that is greater than a length and a width of an internal loop, said coil line forming said two overlapped loops having a same width as a line of substrate disposed therebetween.

According to another embodiment, said two overlapped loops comprise an external loop having a length and a width that is greater than a length and a width of an internal loop, said coil line and a line of substrate disposed therebetween forming said two overlapped loops having a width ratio (WC/WS) comprised between 0.5 and 2.

Preferably, a free end of the line of substrate of the internal loop that forms a central line of the antenna pattern have a width varying from 0.1 to 3 mm.

Advantageously, for tuning the impedance and resonance frequency of the antenna, an impedance network between the feed track and the first ground is added to the antenna pattern. The impedance network must consist of a T network with impedances Z1, Z2 and Z3, Z1 and Z2 being mounted in series between the feed track and the extremity of the coil line of the antenna pattern and Z3 being connected between the first ground and a connection between Z1 and Z2 or of a $\pi$ network consisting of an inductance L1 (typically L1=18 nH) and two capacitors C1 (typically C1=20 pF), C2 (typically C2=7.5 pF), the inductance L1 being mounted between a first extremity of the coil line and the feed track, the capacitor C1 being mounted between the feed track and the first ground and the capacitor C2 being mounted between said first extremity of the coil line and the first ground.

According to an embodiment, for a planar antenna comprising dimensions of 49 mm×18 mm×1.5 mm, said first ground has a length LG1 of 49 mm and a width WG1 of 9 mm, said second ground has a length LG2 of 7 mm and a width WG2 of 5 mm, said feed track has a length LF of 7 mm and a width WF of 2 mm and said third ground has a length LG3 of 7 mm and a width WG3 of 18 mm.

BRIEF DESCRIPTION OF THE DRAWINGS

Other aspects, features and advantages of the present teachings will become clearer to those ordinary skilled in the art upon review of the following description of a specific preferred embodiment of the invention in conjunction with the accompanying drawings where.

DETAILED DESCRIPTION OF EMBODIMENTS

Embodiments include a planar antenna that has a high sturdiness in the 433 MHz band and a small footprint to be embedded in a PDA. More particularly, to meet this last constraint, the planar antenna must have maximal dimensions of 50 mm×20 mm×3 mm.

Figure 1A:
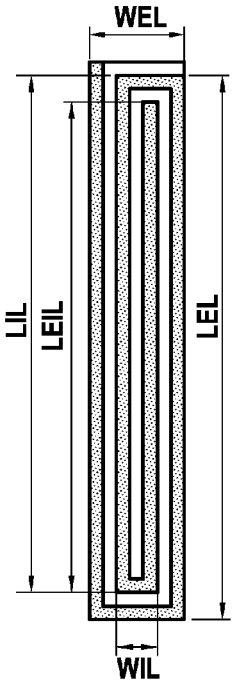
FIG. 1A shows for explanation a negative of the antenna pattern.
Figure 1:
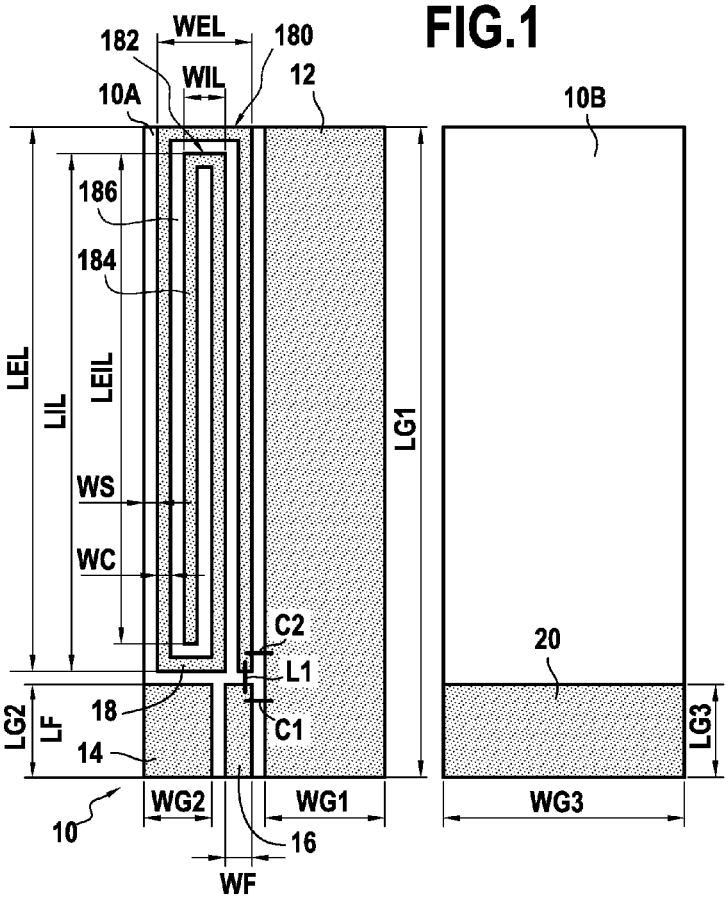
FIG. 1 shows a PCB antenna intended to be embedded in a portable electronic device according to the invention.

To this end, as illustrated on FIG. 1, embodiments of the invention provide a printed circuit board (PCB) antenna comprising a rectangular substrate 10 (length of 49 mm and width of 18 mm) having opposed first 10A and second 10B flat faces. Printing on them, the first flat face comprises a first ground 12, a second ground 14, a feed track 16 and an antenna pattern 18 and the opposed second flat face comprises a third ground 20.

The first ground 12 has a surface (LG1=49 mm and WG1=9 mm) corresponding to about half of the entire surface of the first flat face 10A and the second ground 14 has a surface (LG2=7 mm and WG2=5 mm) corresponding to about a tenth of the first ground 12. The second ground 14 is separated from the first ground 12 by the feed track 16 having a short width (WF=2 mm) and a length of which (LF=7 mm) corresponds to the length LG2 of the second ground 14 which corresponds to about 1/7 of the length LG1 of the first ground 12. The antenna pattern 18 forming a coil line of 1 mm width is disposed into the remaining surface of the first flat face 10A. The coil line comprises two overlapped loops 180, 182, the length (LEL=41 mm) and width (WEL=7 mm) of an external loop 180 being greater than the length (LIL=39 mm) and width (WIL=3 mm) of an internal loop 182, the free end of which having a shorter length (LEIL=37 mm).

One of the features conferring some sturdiness to the antenna is that the two overlapped loops satisfy the Babinet principle in such a way that the antenna pattern is auto-complementary (more precisely substantially (quasi) auto-complementary because the ground plane has a finite dimension). This is possible because the line width is designed to be the same for the coil line 184 (0.1<WC<2 mm and preferably WC=1 mm) and for the line 186 of substrate (0.1<WC<2 mm and preferably WS=1 mm) which lies between the coil loops. The coil line and the substrate line thus form a conductive line and an isolating line, which are auto-complementary (this feature is clearly shown with the negative of the antenna pattern illustrated on FIG. 1A). However, it must be noted that the corresponding free end of the line of substrate (isolation line) of the internal loop that forms a central line of the antenna pattern and has typically a width of 1 mm can have a width varying from 0.1 to 3 mm.

As a result of the auto-complementary design of the antenna pattern geometry, the polarization emitted by the antenna is oblique i.e. not horizontal or not vertical but with a spatial combination that is particularly adapted for reading tags, the position of which are typically vertically or horizontally in the perpendicular plane of the field propagation of the antenna. Thus either vertical or horizontal tags can easily be read by the antenna.

Furthermore, the quasi-homothetic configuration of the pattern geometry confers to the antenna a relatively broad frequency bandwidth, which minimizes detuning resulting from the influence of gripping the PDA by hand and thus maintains stable antenna features. It must also be noted that due to this relatively broad frequency bandwidth, the presence of another antenna (for example when the PDA also comprises a passive RFID reader) does not cause detuning either.

To increase the sensitivity of the antenna, it is further necessary to tune the impedance and resonance frequency of the PCB antenna with for example a Π network consisting of an inductance L1 and two capacitors C1, C2. Such a Π network is added to the antenna pattern 18. The inductance L1 is mounted between a first extremity of the coil line (corresponding to the entrance of the coil line) and the feed track 16. The capacitor C1 is mounted between the feed track 16 and the first ground 12 and the capacitor C2 is mounted between the entrance of the coil line 18 and the first ground 12 too. With the previous dimension sizes of the antenna pattern and for an antenna tuned to 433, 92 MHz, L1=18 nH, C1=20 pF and C2=7.5 pF. It must be noted that said tuning can also be made, in substitution of this u network, with a T network having impedances Z1 and Z2 mounted in series between the feed track 16 and the extremity of the coil line of the antenna pattern 18, an impedance Z3 being connected between the first ground 12 and a connection between Z1 and Z2.

The third ground 20 present on all the width (WG3=18 mm) of the second flat face 10B has a surface corresponding to about 1/7 of the entire surface of this second flat face with a length (LG3=7 mm) corresponding to the length of the second ground 14 and the feed track 16. The object of this third ground that is connected for example through the substrate (not illustrated or via the edge of the substrate) with the first and second grounds is to ensure the continuity of the ground plane.

However, some variation on the dimensions of the grounds or the antenna pattern could be acceptable. For example, a WC/WS ratio comprised between 0.5 and 2 could be acceptable with an appropriate tuning. Similarly, a dimension down to 4 mm is acceptable for the width of the first and second grounds and the length of the second and third grounds.

Figure 2:
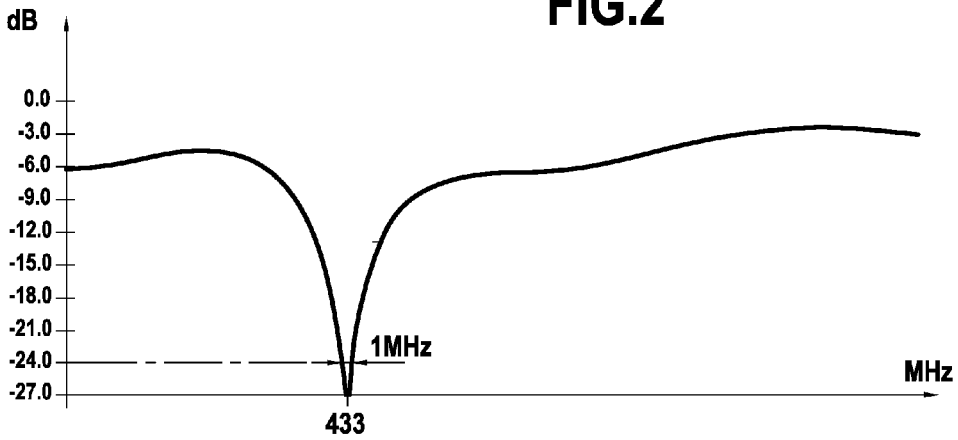
FIG. 2 shows the frequency diagram of the PCB antenna of FIG. 1.

FIG. 2 shows the frequency diagram of the PCB antenna of FIG. 1 when the PCB antenna is installed in the PDA. It must be noted a good adaptation of the antenna (a reading is possible up to 15 meters for example) with a bandwidth of about 1 MHz at −3 dB (which can be compared with a bandwidth of 30 MHz without such impedance network).

Figure 3A:
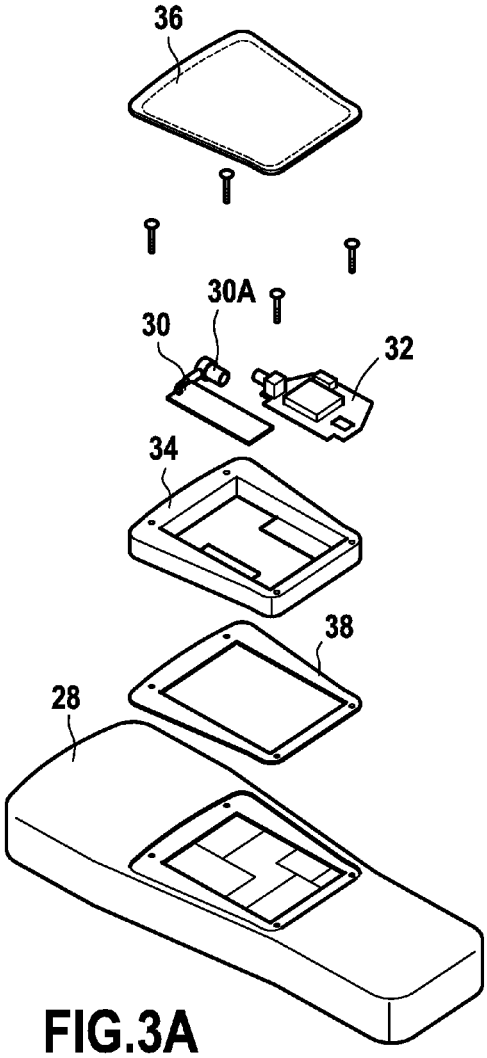
FIGS. 3A and 3B are respectively an exploded view and a back view of a portable electronic device showing the integration of the PCB antenna of FIG. 1 within the portable electronic device.
Figure 3B:
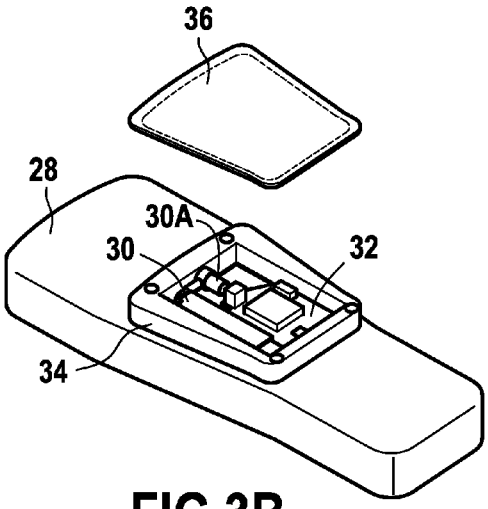
Figure 4:
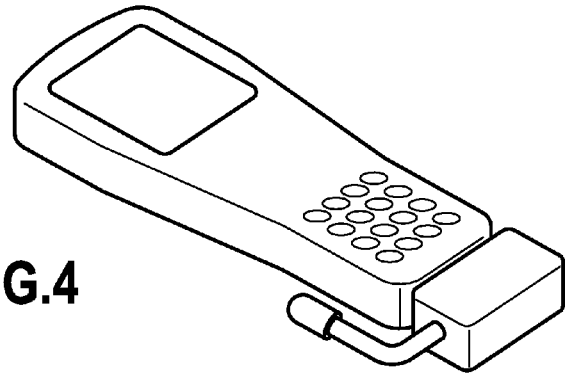
FIG. 4 shows a portable electronic device of the prior art.

FIG. 3A illustrates via an exploded view the integration of the PCB antenna in a hand-held computer such as a PDA. A back view of the PDA when assembled with its cap removed is shown in FIG. 3B. This PDA 28 has an offside extension on the back of its body for embedding the PCB antenna in substitution of the classical add-on with its external antenna. We can see the PCB antenna 30 with its welded feed terminal 30A, a RFID module 32 that comprises all the electronics for processing the signals from the antenna (for example the H310 board of the Identec company) and a roughly rectangular frame 34 of up to 30 mm thickness (typically between 15 and 30 mm) for receiving both the PCB antenna and the RFID module when together connected. A body screw-cap 36 and a sealing joint 38 finish the assembly in order to obtain a portable device that can be used in industrial environment with proper sealing characteristics.

While this invention has been described in connection with a printed circuit board antenna, it is to be understood that the invention is not limited to the disclosed embodiment, but on the contrary, is intended to cover various modifications and equivalent arrangements of a planar antenna included within the spirit and scope of the appended claims.

The various embodiments described above can be combined to provide further embodiments. All of the commonly assigned US patent application publications, US patent applications, foreign patents, and foreign patent applications referred to in this specification and/or listed in the Application Data Sheet, including but not limited to European Patent Application No. 14306398.0.3, filed Sep. 11, 2014 is incorporated herein by reference, in their entirety. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A planar antenna comprising:

a substrate having opposed first and second flat faces;

the first flat face comprising a first ground, a second ground, a feed track and an antenna pattern and the opposed second flat face comprising a third ground;

the second ground being separated from the first ground by the feed track;

the third ground being connected to first and second grounds for ensuring the continuity of the ground plane;

wherein the antenna pattern forming a coil line is disposed into the remaining surface of the first flat face and comprises two overlapped loops in such a way that the antenna pattern is substantially auto-complementary, and the first around has a surface corresponding to about half of the entire surface of the first flat face and the second ground has a surface corresponding to about a tenth of the first ground.

2. The planar antenna according to claim 1, wherein said two overlapped loops comprise an external loop having a length and a width that is greater than a length and a width of an internal loop, said coil line forming said two overlapped loops having a same width as a line of substrate disposed therebetween.

3. The planar antenna according to claim 2, wherein a free end of the line of substrate of the internal loop that forms a central line of the antenna pattern have a width varying from 0.1 to 3 mm.

4. The planar antenna according to claim 1, wherein said two overlapped loops comprise an external loop having a length and a width that is greater than a length and a width of an internal loop, said coil line and a line of substrate disposed therebetween forming said two overlapped loops having a width ratio (WC/WS) comprised between 0.5 and 2.

5. The planar antenna according to claim 4, wherein a free end of the line of substrate of the internal loop that forms a central line of the antenna pattern have a width varying from 0.1 to 3 mm.

6. The planar antenna according to claim 1, wherein for tuning the impedance and resonance frequency of the antenna an impedance network between the feed track and the first ground is added to the antenna pattern.

7. The planar antenna according to claim 6, wherein the impedance network consists of a T network with impedances Z1, Z2 and Z3, Z1 and Z2 being mounted in series between the feed track and the extremity of the coil line of the antenna pattern and Z3 being connected between the first ground and a connection between Z1 and Z2.

8. The planar antenna according to claim 6, wherein the impedance network consists of a π network with of an inductance L1 and two capacitors C1, C2, the inductance L1 being mounted between a first extremity of the coil line and the feed track, the capacitor C1 being mounted between the feed track and the first ground and the capacitor C2 being mounted between said first extremity of the coil line and the first ground.

9. The planar antenna according to claim 8, wherein L1=18 nH, C1=20 pF and C2=7.5 pF.

10. The planar antenna according to claim 1, wherein said first ground has a length LG1 of 49 mm and a width WG1 of 9 mm.

11. The planar antenna according to claim 1, wherein said second ground has a length LG2 of 7 mm and a width WG2 of 5 mm.

12. The planar antenna according to claim 1, wherein said feed track has a length LF of 7 mm and a width WF of 2 mm.

13. The planar antenna according to claim 1, wherein said third ground has a length LG3 of 7 mm and a width WG3 of 18 mm.

14. The planar antenna according to claim 1, wherein the substrate is constituted by a printed circuit board (PCB).

15. Hand-held computer such as a PDA comprising a printed circuit board antenna according to claim 14.

16. The planar antenna according to claim 1, wherein said two overlapped loops comprise an external loop having a length and a width that is greater than a length and a width of an internal loop, said coil line forming said two overlapped loops having a same width as a line of substrate disposed therebetween.

17. The planar antenna according to claim 1, wherein said two overlapped loops comprise an external loop having a length and a width that is greater than a length and a width of an internal loop, said coil line and a line of substrate disposed therebetween forming said two overlapped loops having a width ratio (WC/WS) comprised between 0.5 and 2.

18. The planar antenna according to claim 1, wherein for tuning the impedance and resonance frequency of the antenna an impedance network between the feed track and the first ground is added to the antenna pattern.

* * * * *